United States Patent [19]

Mills et al.

[11] 4,189,134

[45] Feb. 19, 1980

[54] METHOD FOR MULTI-FOLDING A NEWSPAPER OR THE LIKE

[75] Inventors: Douglas C. Mills; Jeffrey A. Clark, both of Adrian, Mich.

[73] Assignee: Saxmayer Corporation, Blissfield, Mich.

[21] Appl. No.: 913,300

[22] Filed: Jun. 7, 1978

[51] Int. Cl.[2] ..... B65H 45/22

[52] U.S. Cl. ..... 270/66; 270/86; 53/120

[58] Field of Search ..... 270/66, 86–94, 270/67, 83–85; 53/116, 117, 120; 93/84 R, 84 TW, 45, 47

[56] References Cited

U.S. PATENT DOCUMENTS

| | | | |
|---|---|---|---|
| 3,053,024 | 9/1962 | Wexler | 53/120 |
| 3,060,658 | 10/1962 | Horsting | 53/120 |
| 3,919,827 | 11/1975 | Larson | 53/120 |

*Primary Examiner*—Edgar S. Burr
*Assistant Examiner*—A. Heinz
*Attorney, Agent, or Firm*—Henry K. Leonard

[57] ABSTRACT

A method for folding a newspaper tightly into compacted W-shaped cross-sectional configuration and for retaining the newspaper in that form by mechanical means wrapped around its exterior. A conventionally half-folded newspaper, for example, as produced by a standard printing press, is continuously moved along a path that is perpendicular to the center of the half-fold, folded back upon itself along a quarter-fold line coincident with the path and folded forwardly along eighth-fold lines that are parallel to and on opposite sides of the quarter-fold line and that are equidistant from the quarter-fold line and the lateral edges of the newspaper. The folded newspaper in this "W" configuration is compacted laterally, bringing its folded portions tightly against each other and a retaining element is wrapped around its exterior. The retaining element preferably is a sealed jacket of moisture-proof sheet material which is progressively formed around the compacted newspaper as it continues along the path.

8 Claims, 16 Drawing Figures

20
21
22
23
24
27
28
29
30
31
32
33
34
35
36
37
38
39
40
41
42
43
60
61
N14

METHOD FOR MULTI-FOLDING A NEWSPAPER OR THE LIKE

BACKGROUND OF THE INVENTION

In speaking of a multi-folded compacted newspaper, or the like, and a method for so folding the newspaper which constitute the instant invention, it will be convenient to speak of a "half-folded" newspaper. That term will be utilized to descibe two types of newspapers: (1) a standard or regular newspaper in the configuration in which it is discharged by the printing press, i.e., the front page of the newspaper and all other pages are folded in half along a fold line which is parallel to the headline of the newspaper; and (2) a so-called "tabloid" type newspaper in which all of the sheets of the newspaper are folded upon themselves along a line which is perpendicular to the headline of the front page. In both instances, of course, the overall size of the "half-folded" newspaper is generally the same.

In addition, subsequent folds which are made according to the invention will be described as a "quarter-fold" and or "eighth-folds". These two folds, respectively, are a fold of the entire newspaper along a center line perpendicular to the half-fold line and secondly, two fold lines which are parallel to the "quarter-fold" and which, thus, are "eighth-folds" and extend along lines spaced midway between the "quarter-fold" and the edges of the newspaper, the fold lines and the edges all being perpendicular to the first half-fold line.

Traditionally, newspapers delivered to residences have been carried in their "half-folded" condition by paper boys and laid on the front porch. This often resulted in the paper being blown apart so paper boys learned to roll the papers, if not too thick, and tuck the roll between the sheets at one edge. It then became common for the rolled paper to be tossed onto the porch and, often, it fell into a puddle or a snow bank or came open while going through the air.

Because of the foregoing difficulties in delivering newspapers many suggestions have been made for machines or methods for folding the papers into a smaller size, as for example, by first quarter-folding and eighth-folding the paper, or by rolling it up from one side and encircling the paper with a retainer such as a rubber band. These systems tend to minimize the likelihood that sheets of the paper may blow away or become disengaged from each other during handling and they provide a more compact item which more readily can be handled.

Multi-folding and thus minimizing the apparent area of a newspaper has become even more important during recent years because of the increased costs of delivery of newspapers, particularly to homes. In many cities, indeed, newspaper carriers have been eliminated and newspapers are delivered to residential areas from a delivery truck with the operator simply throwing the compacted newspaper toward the house, hopefully onto the front porch.

This system of delivery presents two major problems. First, the multi-folded compacted newspaper must be so tightly held in that position that it will not open during its travel through the air enroute from the deliveryman to the porch and second, it should be protected so that in inclement weather it will not be spoiled by falling either into a mud puddle or into a bank of snow.

For the foregoing reasons, apparatuses have been developed in which the newspapers are quarter-folded along a medial line perpendicular to the half-fold and then both quarter sections are eighth-folded in the same direction along a second line parallel to and spaced from the quarter-fold line. Because these machines involve intermittent actuations of the folding means, the newspapers cannot progress continuously through the machines but are stopped and started frequently which has an unfortunate tendency to tear their surfaces or to cause them to jam in the folding mechanisms.

In some instances, half-folded newspapers also have been rolled either parallel to the half-fold or perpendicular thereto and then inserted in preformed open ended bags or sleeves or protective sheet material, in some instances even plastic films. In other cases, rolled newspapers have been overwrapped by sheets of paper such as Kraft paper, the overwrap then being retained in overwrapping position by adhering overlapping edges thereof to each other, or in other ways.

An apparatus for folding and rolling a newspaper along fold lines around an axis parallel to the "half-fold" and placing thereon an overwrap is disclosed in Hannon et al U.S. Pat. No. 3,161,000.

In most instances, prior art apparatuses and methods which have been provided for folding newspapers into configurations of lesser overall size than the half-folded newspapers have folded the newspaper in the same direction in each successive fold. This has requirded the use of folding blades which force the newspaper between chutes or rollers, or, the continued folding or rolling of the newspaper upon itself in the same direction.

While some success has been achieved by a prior art method employing mechanisms which roll the newspapers, wrap them in paper and tie them in the rolled shape, those mechanisms are complicated and are difficult to maintain in good working condition. In other prior art methods and machines, manual insertion of the folded newspapers into protective bags is required. In other suggested methods, it has been difficult to provide the apparatuses for carrying them out which securely fasten the newspapers in rolled or folded configuration without an unsatisfactory percentage of damaged or torn newspapers.

It is therefore the principal object of the instant invention to provide a multi-folded newspaper and a method for so folding it that the newspaper can move continuously through an apparatus designed to carry out the method with minimized risk of damage to the newspaper to present the multi-folded newspaper to means for releasably retaining it in compact, multi-folded condition. These means may be either a tying mechanism which wraps a string or other restricting means around the exterior of the multi-folded newspaper or, as a further example, a continuously operated wrapping means which encloses the newspaper within a sheet of paper or plastic film which preferably is moisture proof.

It is yet another object of the instant invention to provide a multi-folded newspaper having a particular configuration which results from its continuous folding according to the method of the invention and its subsequent retention in that configuration.

DESCRIPTION OF PREFERRED EMBODIMENT

Figures 1, 2, 3, 4, 5, 6, 7, 8, 10:
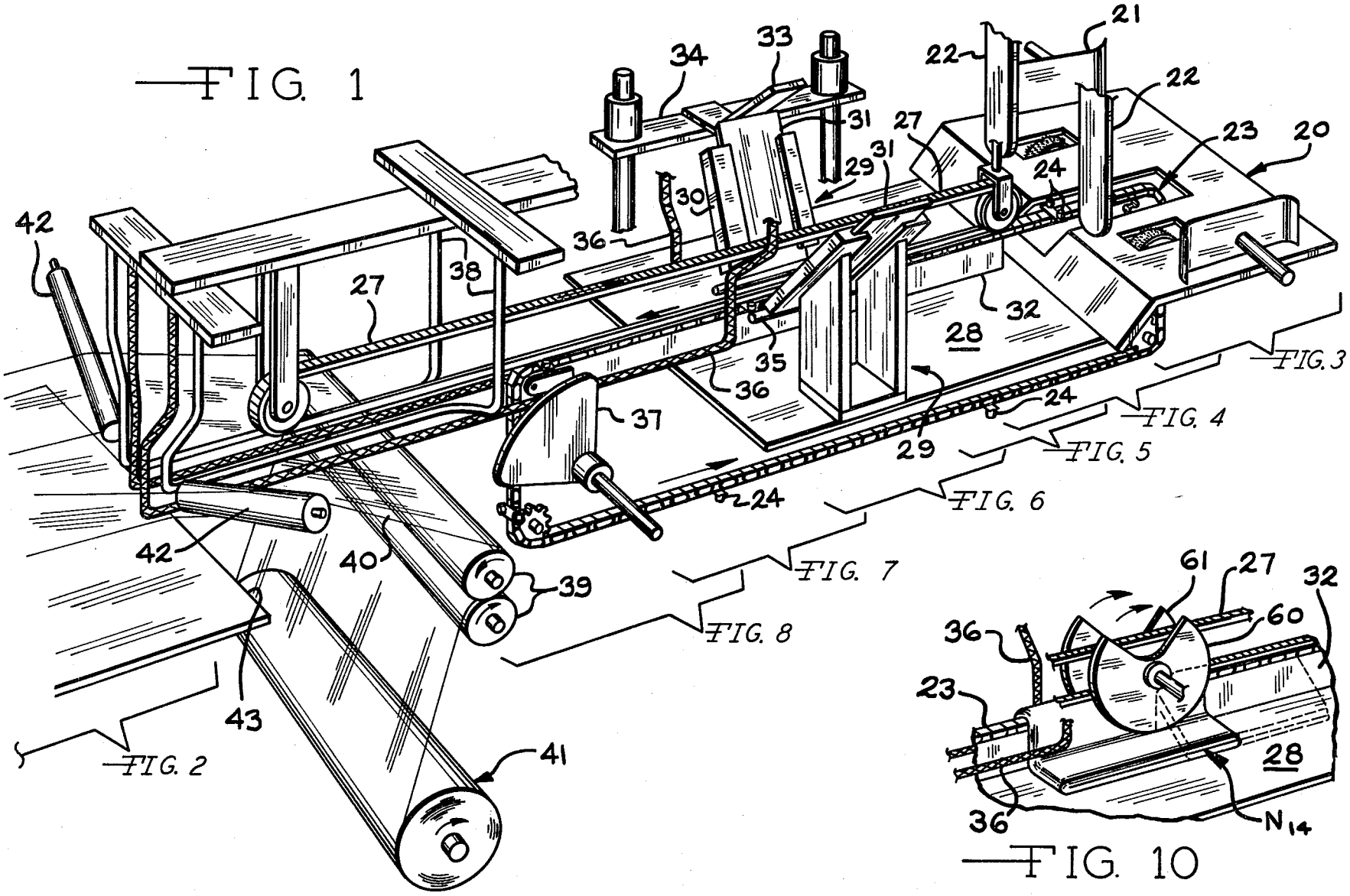
FIG. 1 is a fragmentary, somewhat diagrammatic view of an apparatus upon which the method of the invention can be carried out in order to produce a compact, multi-folded newspaper embodying the invention.
FIG. 2 is a view similar to FIG. 1 illustrating a mechanism which follows the mechanism shown in FIG. 1 by which an additional step of the method embodying the invention may be carried out to provide the multi-folded newspaper with a moisture-proof protective jacket.
FIGS. 3–8 inclusive are fragmentary detailed views in perspective, showing sequential steps according to the method by which half-folded newspapers first can be quarter-folded, then eighth-folded, and then compacted according to the method embodying the invention to produce a newspaper according to the invention as illustrated in FIG. 2*a;* each of FIGS. 3–8 being taken approximately from the respective position indicated by a similarly numbered bracket on FIG. 1.
FIG. 10 is a view in perspective of a different folding apparatus which could be used in place of the apparatus shown particularly in FIG. 6.

While the word "newspaper" will be utilized throughout this specification to refer to the items being folded by the method of invention, it will be realized that the method is equally applicable for use in multi-folding into compact configuration items other than newspapers but which are generally similar to newspapers in their initial form. Furthermore, in discussing the apparatus illustrated in the drawings on which the method of the invention can be carried out no reference will be made to specific electrical or mechanical means by which portions of the apparatus are actuated other than to describe the movements produced in timed sequence to the continuous movement of the newspaper through the steps embodying the invention. In addition, although reference will be made to specific mechanisms and their functioning, it will be appreciated that insofar as the method of the invention is concerned, these mechanisms merely are illustrative and the method is not limited to the utilization of any specific ones of the mechanisms shown.

The illustrated apparatus for carrying out the method of the invention has a loading table 20 upon which an operator places a stack of half-folded newspapers generally indicated by the letter "N". The table 20 has side guides 21 (FIGS. 1 and 3) and retaining bars 22. The retaining bars 22 extend from an overhead structure (not shown) downwardly toward the table 20 terminating a distance above the table 20 such that a "throat" is provided through which the bottommost one of the newspapers "N" (designated by the letter "$N_1$") is fed.

Feeding means for the bottommost one of the newspapers is shown in FIG. 1 and 4 and consists of a continuously moving chain 23 which carries spaced sets of dogs 24 (FIG. 4). The sets of dogs 24 are spaced along the length of the chain 23 a distance from each other a few inches (say 4 inches) in excess of the half-folded height of one of the newspapers "N". The feeding means also comprises a pair of continuously driven rollers 25, the peripheries of which extend upwardly to the level of the table 20, and each of which has a short segment provided with tack points 26, or the like. The diameter of the feeding rollers 25 and the circumferential extent of the surface thereof bearing the tack points 26 are such that the tack points 26 engage the under surface of the lowermost newspaper "$N_1$" at the same time that a pair of the dogs 24 comes into contact with its trailing edge. Thus, the newspapers "N" are sequentially fed from the bottom of the stack by the feeding rollers 25 and the chain dogs 24, an operator or an earlier mechanism placing additional half-folded newspapers on top of the stack "N" as needed in order to maintain a continuous supply of newspapers.

When a newspaper is fed off of the table 20 by the dogs 24, its leading edge almost immediately enters a nip between the feeding chain 23 and an overhead rubber belt 27 thus to continue the movement of the newspaper as is illustrated in FIG. 4 where a newspaper "$N_2$" is shown just after it has left the surface of the table 20.

It will be noted that the upper flight of the chain 23 is spaced substantially above an apparatus bed 28 so that, as the newspaper moves from the position illustrated in FIG. 4 to the position illustrated in FIG. 5, its lateral edges drop downwardly into contact with the surface of the bed 28, a newspaper indicated as "$N_3$" being shown in that position in FIG. 5.

Continuous movement of the newspaper by the chain 23 and the belt 27 carries the newspaper along until it reaches a position illustrated in FIG. 6 between a pair of quarter-folders generally indicated by the reference No. 29. Each of the quarter-folders 29 comprises a guide 30 in which is slidingly mounted a folding blade 31, the guides 30 providing for reciprocal movement of the blades 31 at an angle of approximately 45° to the horizontal, downwardly and inwardly toward a longitudinal track 32 along the upper edge of which the upper flight of the chain 23 slides. The folding blades 31 are actuated in timed sequence to the movement of the particular newspaper by inwardly protruding strike plates 33, only one of them being shown in each of FIGS. 1 and 6, but, of course, there being a similar strike plate 33 for each of the folding blades 31. Each of the strike plates 33 is carried by a vertically movable crossbar 34 and thus is reciprocated up and down, the down strokes causing the strike plates 33 to engage the folding blades 31 and thrust them downwardly and inwardly. Each of the folding blades 31 has a creasing rod 35 on its lower edge which squeezes the newspaper "$N_4$" against the intersection between the track 32 and the apparatus bed 28 as illustrated in FIG. 6.

As also can be seen in FIG. 6, immediately after the newspaper "$N_4$" is creased by the creasing rods 35 its leading edge passes between a pair of spaced guides 36 extending generally horizontally along opposite sides of the track 32 and spaced away from the track 32 only a distance sufficient to allow the newspaper to pass between the guides 36 and the track 32. Thus, the guides 36 squeeze the newspaper inwardly on opposite sides of the track 32 as the newspaper "$N_4$" moves from the position shown in FIG. 6 to the position in FIG. 7 indicated by the number "$N_5$".

As the newspaper approaches the position illustrated in FIG. 7, its leading edge overlies the path of a pair of rotary vanes 37 which are mounted upon a shaft 37*a* and are rotated in timed sequence to the movement of the newspapers along the path being described. By the time in particular newpaper ("$N_5$") reaches a position just short of that illustrated in FIG. 7, the vanes 37 have been rotated around so that their leading corners engage beneath the then horizontally lying outboard quarters of the newspaper to cause it to be swung upwardly progressively as the vanes 37 rotate and the newspaper "$N_5$" moves from the position illustrated in FIG. 7 to the position illustrated in FIG. 8 where the newspaper indicated as "$N_6$" is shown.

Shortly prior to the time when the newspaper reaches the position illustrated in FIG. 8, its leading edge, now folded upwardly so that the newspaper "$N_6$" in cross-section has a configuration somewhat like a "W", enters spaces between a second pair of guides 38 which are spaced outwardly of the guides 36 and at a higher level and which thus keep the lateral edges of the newspaper "$N_6$" folded upwardly from there on.

WRAPPING OR RETAINING STEPS

The method embodying the invention also comprises steps by which the compacted, multi-folded newspaper in the loose "W" configuration, as illustrated particularly in FIG. 8, is either wrapped or enclosed within a jacket, preferably of moisture-proof plastic film or, when that is not necessary or desired, is tied tightly in that configuration. These method steps are illustrated more completely in the leftmost portion of FIG. 1 and in FIG. 2 which is a continuation thereof, on the one hand, and in FIG. 9, on the other.

When the newspapers are to be enclosed within jackets of sheet material, preferably moisture-proof, a pair of transversely extending, feeding and support rollers 39 (see FIGS. 1 and 8) are positioned just beyond the location of the vanes 37 and feed a continuous web 40 of sheet material that is led off of a supply roll 41. Preferably, the sheet material is transparent so that after a newspaper is wrapped it can be seen clearly, although the particular nature of the wrapping material is not critical. Preferably, again, the sheet material is one which has a cohesive coating on one of its surfaces, i.e., that surface which is innermost on the supply roll 41 and thus uppermost when the web 40 is led upwardly between the feeding rollers 39 and around and over the top of the upper one of the rollers 39. It will be noted (FIG. 1) that the feeding chain 23 is led around idler sprockets downwardly away from the path of the newspapers so that the chain 23 no longer supports the newspapers after they leave the position of FIG. 8. However, after the newspaper ("$N_6$") departs from the position of FIG. 8, it contacts the web 40 and is supported by the uppermost one of the feeding rollers 39, as it is moved along by the web 40.

The web 40 is then led over a pair of laterally spaced, inclined guide rollers 42, one of the rollers 42 being positioned on each side of the path of movement of the newspapers and approximately at the ends of the guides 36 and 38. The central portion of the web 40 engages the surface of a table 43 and the leading edge and, gradually, the entire newspaper "$N_6$" of FIG. 8, is moved with the web 40 onto the table 43 as illustrated by the newspaper "$N_7$" of FIG. 2.

During this progression from the position illustrated in FIG. 8 to the position of the newspaper "$N_7$" in FIG. 2, the side guides 36 and 38 gradually approach each other from opposite sides of the center line of movement of newspapers so as progressively to decrease the "angles", as it were, between the four arms of the "W" configuration.

The web 40 and each successive newspaper, in moving from the position indicated by the newspaper "$N_7$" (FIG. 2) to the position indicated by the newspaper "$N_8$", are led between a pair of inwardly inclined guide plates 44 mounted on the table 43 so that when the newspaper reaches the position indicated as "$N_8$" the four quarter sections have been squeezed toward each other until they are close to contact throughout their interfaces.

Immediately after departing from the space between the guide plates 44, the web 40 and each newspaper in sequence are led between a pair of cylindrical sealing rollers 45 which are mounted upon arms 46 and urged toward each other by a spring 47.

Because of the spacing between successive ones of the newspapers which are moving along with the web 40, the rollers 45 press the opposed half-web portions of the web 40 against each other ahead of and behind each successive newspaper to cause the cohesive coating on the now inner surfaces of the two half-webs to adhere. This produces a seal at both ends of each edge of a first newspaper and the leading edge of a subsequent newspaper.

Immediately after the newspaper, for example, the newspaper "$N_9$" of FIG. 2, departs from between the cylindrical sealing rollers 45, the upper edge of the folded web 40 is led between a pair of sealing discs 48, one positioned on each side of the web. The discs 48 are mounted on and rotated by shafts 49 on the upper ends of which are a pair of engaged gears 50 which are driven by a mechanism not shown. The sealing discs 48 squeeze the free edges of the half-webs of the web 40 to each other to feed it and the successive newspapers "$N_7$", "$N_8$" and "$N_9$".

The sealing discs 48 would be provided with rims composed either of a rubberlike material or would have knurled surfaces, as might be necessary, in order to continue to exert tension on the web 40 to insure feeding the web and the several newspapers along the path just described.

Each newspaper then passes between a pair of opposed cutting bars 51 which have cooperating means and which are moved inwardly toward each other to sever the web 40 between the trailing edge of each newspaper and the leading edge of a following newspaper thus cutting off each wrapped newspaper from the web so that it can then be collected with similar newspapers into some form of container by mechanisms not shown and subsequently handled for delivery.

Shortly prior to the time when a newspaper reaches the position indicated at "$N_{10}$" and while the enclosed paper still is being fed forwardly by the sealing discs 48, the leading edge of its wrapper enters a nip between a pair of driven discharge rollers 52 which are mounted on the table also supporting the cutting bars 51 and other mechanisms and which are spring pressed towards each other by mechanism not shown. The discharge rollers 52 pull the chain of papers along and discharge each individual paper after the cutters 51 have severed that paper from the continuous length.

Figures 2, 2A:
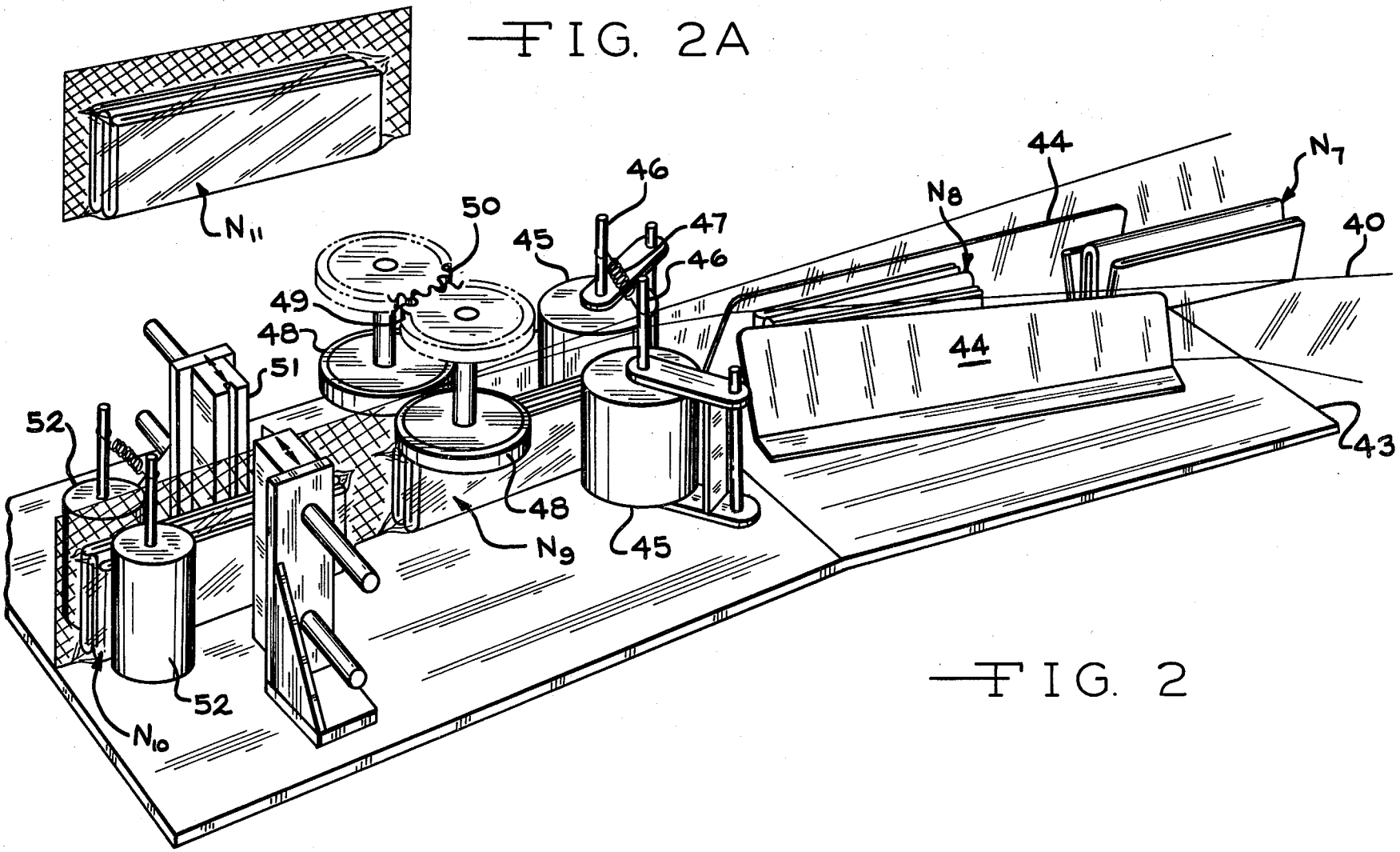
FIG. 2*a* is a view in perspective showing a newspaper embodying the invention wrapped in a moisture-proof plastic wrapping.
Figure 3:
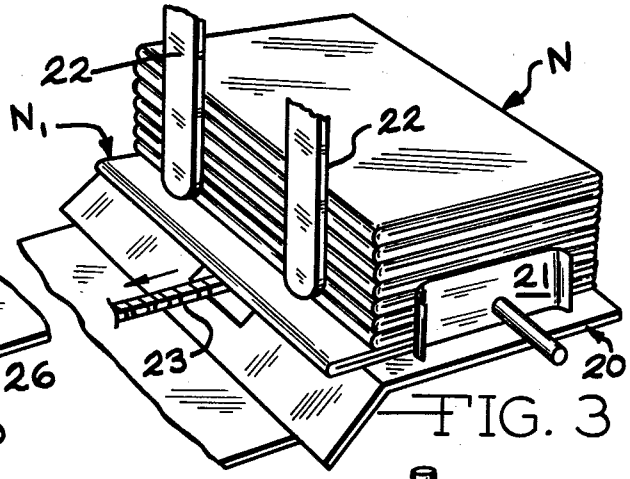
Figure 6:
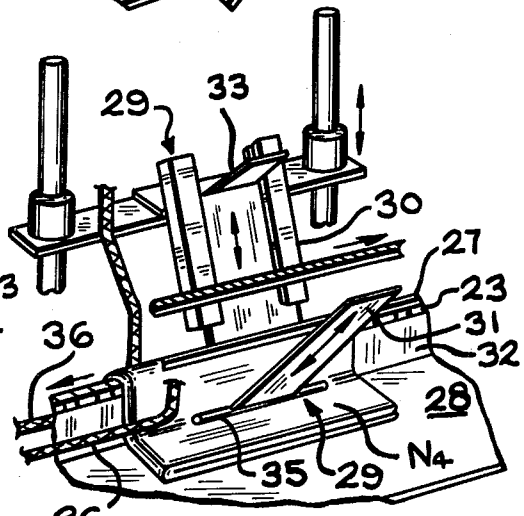
Figure 4:
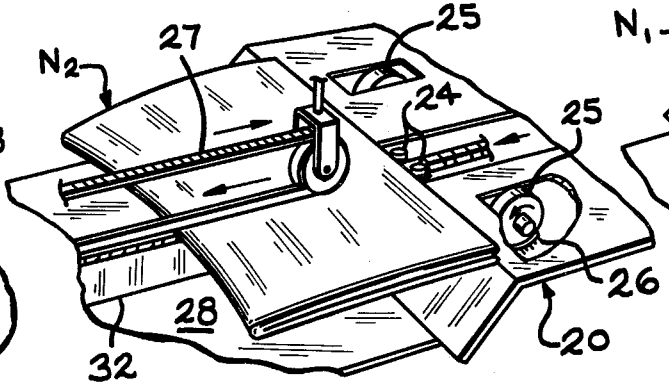
Figure 7:
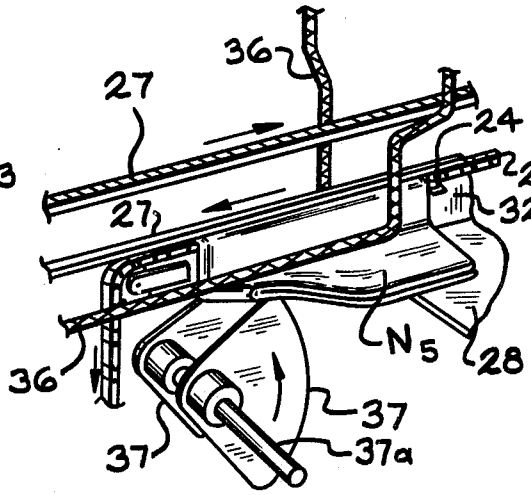
Figure 5:
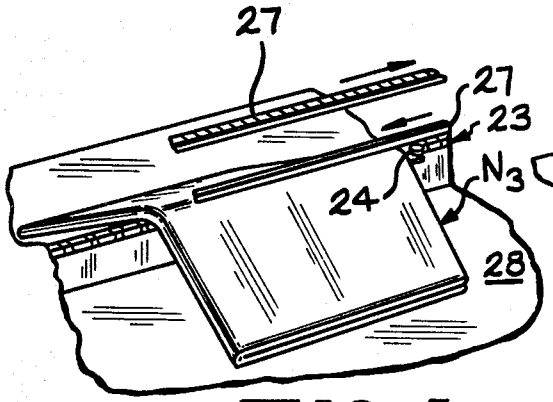
Figure 8:
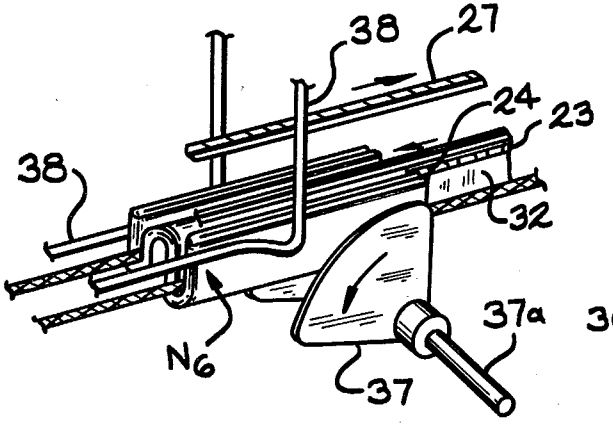

FIG. 2*a* illustrates a newspaper "$N_{11}$" fully enclosed in a sealed, moisture-proof jacket with its four quarter-sections tightly squeezed together to make a compact self-contained package according to the invention.

ALTERNATIVE METHOD STEPS

Figure 9:
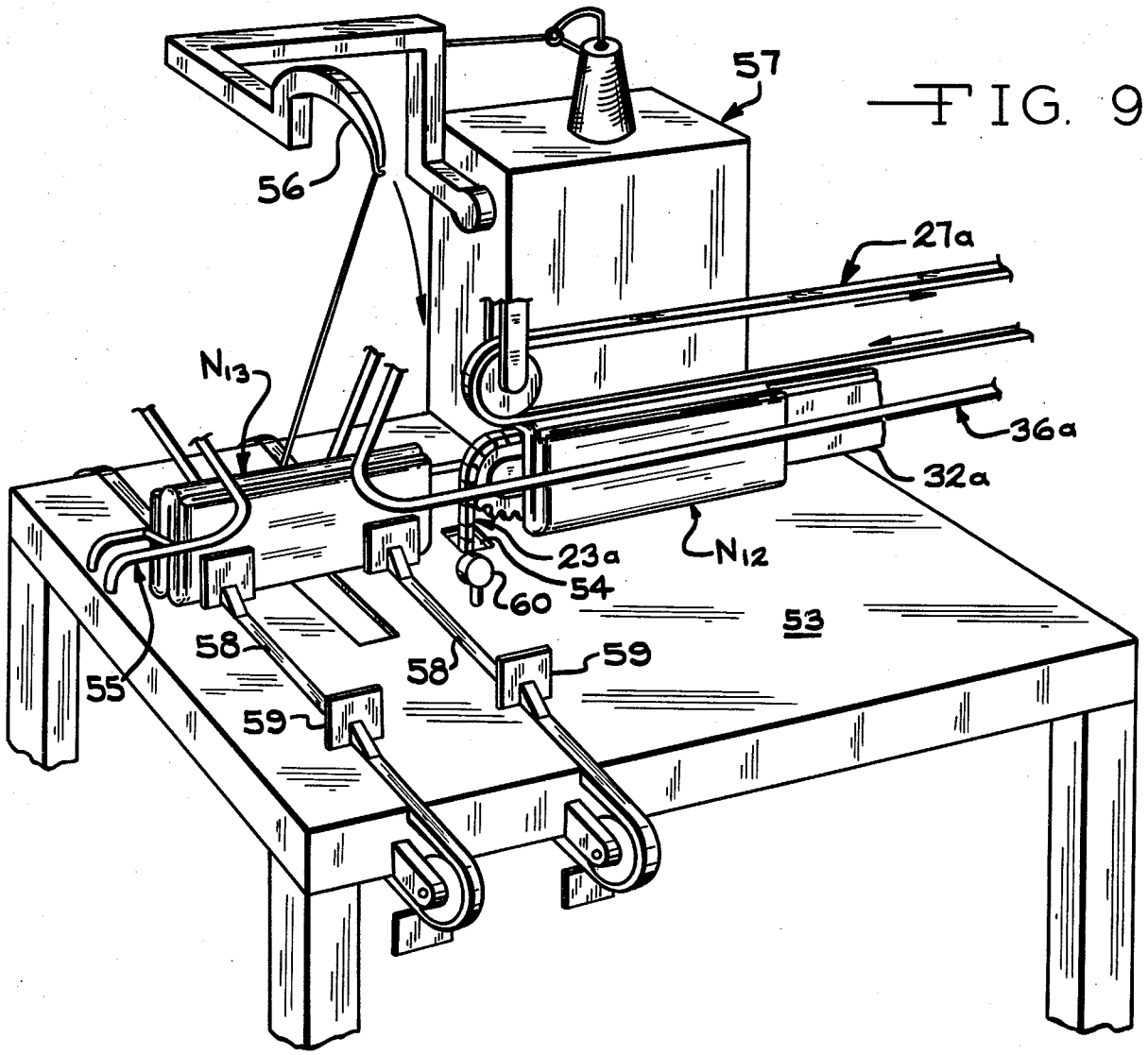
FIG. 9 is a view in perspective illustrating an alternative method step by which a multi-folded newspaper according to the invention is retained in its compact, folded condition by being tied by an automatic bundle tier.

FIG. 9 illustrates an alternative method for binding the folded newspaper in its tightly compacted condition. An extension of the feeding belt 27, indicated by the reference No. 27*a*, is shown as extending longitudinally over an extension 32*a* of the track 32 which overlies a tying machine table 53. A longer feeding chain indicated by the reference No. 23*a*, rides along the top of the extended track 32*a* and is carried downwardly through an opening 54 in the table 53 and thence back to the feeding table 20 (see FIGS. 1 and 3). Extensions 36*a* of the guides 36 lie closely adjacent opposite sides of the track 32*a* and maintain a newspaper in tightly folded "W" configuration as it moves along over the table 53, a newspaper in FIG. 9 in that position being indicated by the letter "$N_{12}$".

The guides 36*a* extend beyond the chain 23*a* and the belt 27*a* and guide a newspaper from the position indicated as "$N_{12}$" to a position indicated as "$N_{13}$", the leading end of the newspaper "$N_{13}$" being "projected" between the spaced ends of stop guides 55 erected on the table 53 in alignment with the guides 36*a*.

When the newspaper "$N_{13}$" reaches the position shown in FIG. 9, it is centered relative to the path of movement of a tying needle 56 of a conventional bundle tying machine generally indicated by the reference No. 57 and, also, has passed over a pair of cross belts 58 which have spaced paddles 59. A photocell 60 is mounted on the table 53 and actuated by the re-establishment of a light beam from a source (not shown) which occurs when the newspaper reaches the position indicated by the reference No. "$N_{13}$". Reactuation of the photocell 60 energizes the tying machine 57 to sweep its needle 56 around the newspaper "$N_{13}$" to tie it tightly to retain it in the compacted configuration.

The cross belts 57 are driven by mechanism (not shown) in timed sequence to the movement of the feed chain 23*a* and belt 27*a* so that immediately after the newspaper "$N_{13}$" had been tied by the mechanism 57, a pair of the paddles 59 engages the newspaper "$N_{13}$" and pulls it out from its position between the ends of the guides 36*a* and 55, discharging the then tied newspaper to a receptacle or further conveyor (not shown).

The mechanism shown in FIG. 9 is illustrative of an alternative step of the method wherein the newspapers are tied in their compacted configuration without being enclosed in jackets.

FIG. 10 illustrates an alternative way in which the first fold of a newspaper may be accomplished and shows a newspaper indicated by the letter "$N_{14}$" in a position comparable to the newspaper "$N_4$" of FIG. 6. A pair of notched rotary folding discs 61 are utilized instead of the folding blades 31 to sweep the opposite halves of the newspaper (FIG. 5) downwardly and inwardly tightly against opposite sides of the track 32 and down against the apparatus bed 28. The two discs 61 are rotated by mechanism (not shown) which is synchronized with the movements of the feeding chain 23 and feeding belt 27 to initially fold the newspaper "$N_{14}$" as shown in FIG. 10, as it is fed along and into the space between the first guides 36.

FIGS. 11–15, inclusive, illustrate an alternative initial feeding mechanism by which individual newspapers are fed from the bottomside of the stack of newspapers "N" (see FIG. 3).

As in the earlier figures, a support table 20*a* has side guides 21*a* and retaining bars 22*a*. The apparatus also has a feeding chain 23*a* which has feeding dogs (not shown in FIGS. 11–15) similar to the dogs 24 and an overhead belt 27*a*. As in the earlier illustrated mechanism, the mechanism shown in FIGS. 11–15 functions for performing the initial method step of moving the lowermost newspaper out of the bottom of the stack "N", such a newspaper being indicated by the number "$N_{12}$" in FIGS. 11–15.

The alternatively usable feeding mechanism comprises a pair of feeding arms 62 and 63 each of which is mounted on a vertical shaft 64. The shafts 64 are simultaneously rotated by drive means (not shown) so that they complete a revolution of the two feeding arms 62–63 for each individual newspaper being fed from the stack "N".

Each of the feeding arms 62–63 is locked on its respective shaft 64 by a set screw 65 or the like both to position it angularly relative to the shaft 64, and thus the timing of the entire apparatus which carries out the method of the invention, and also to position it vertically relative to the table 20*a*. As best can be seen by comparing FIGS. 12 and 13, the feeding arm 63 is positioned at a level above the table 20*a* so that it cuts into the space between the front and the back halves of the particular half-folded newspaper and the feeding arm 62 is positioned closer to the table 20*a* so that it enters between sheets in the back half of the newspaper, for example, some four or five sheets above the surface of the table 20*a*. Both of the feeding arms 62 and 63 have beveled front edges to facilitate their entry between the various sheets of the newspaper. The heighth of the arm 63 above the table is determined by the number of sheets in the run of newspapers being produced.

Figure 14:
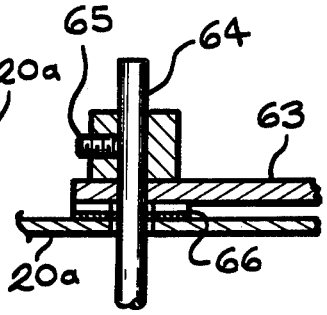
FIG. 14 is a fragmentary, vertical sectional view taken along the line 14—14 of FIG. 11.

It will be noted, particularly, in FIG. 14, that the two arms are urged upwardly from the table 20*a* into their adjusted positions, for any particular newspapers having a particular number of sheets, by split washers or similar means, a so-called "Belleville" washer being illustrated at 66 in FIG. 14.

Figure 11:
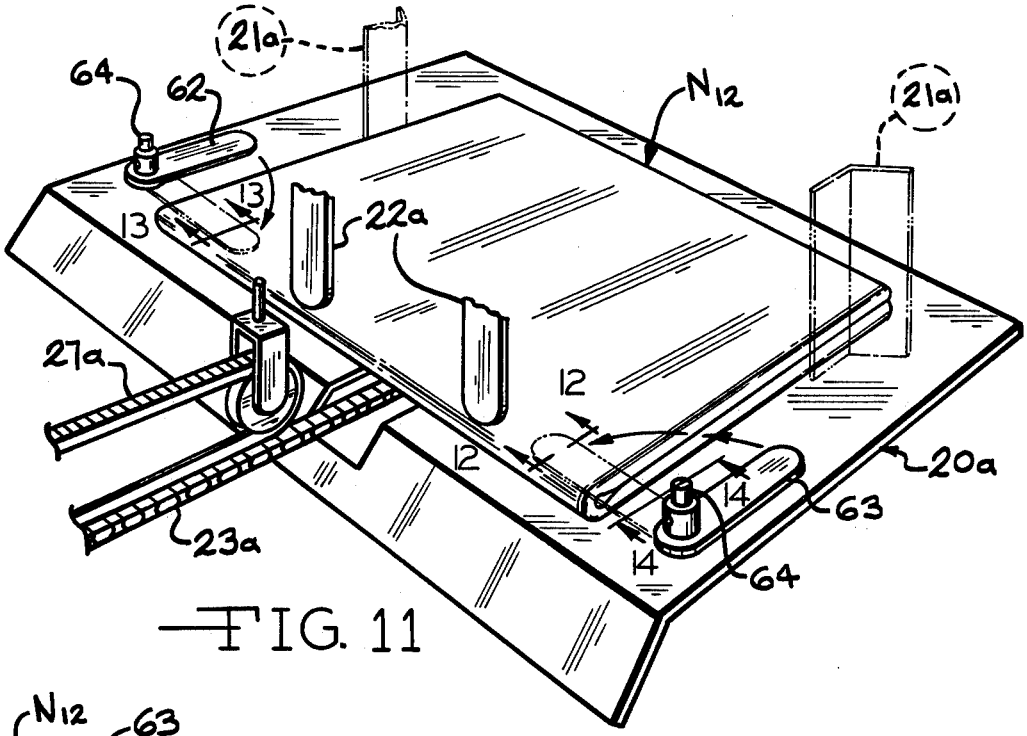
FIG. 11 is a fragmentary view in perspective showing a mechanism which is alternative to that shown in FIGS. 1 and 4 for initially feeding newspapers from a stack.
Figure 12:
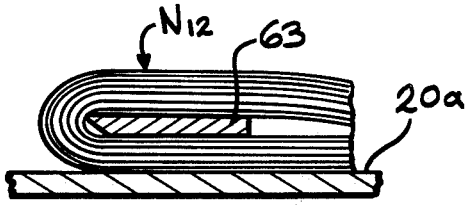
FIG. 12 is a fragmentary, vertical sectional view on an enlarged scale taken along the Line 12—12 of FIG. 11.
Figure 13:
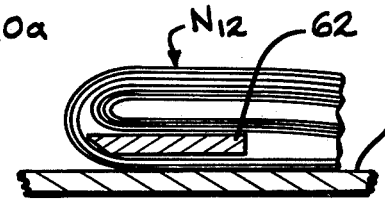
FIG. 13 is a view similar to FIG. 12 but taken along the Line 13—13 of FIG. 11.
Figure 15:
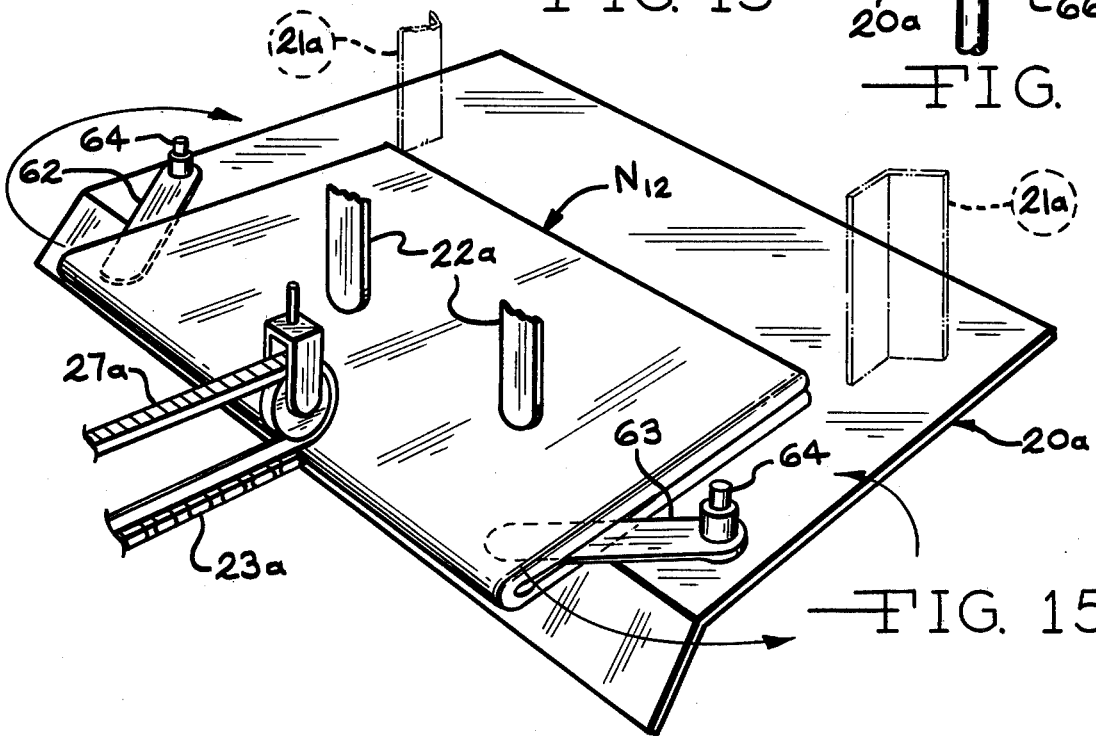
FIG. 15 is a view similar to FIG. 11 and showing a newspaper as it departs from a stack.

By comparing FIGS. 11 and 15 it will be seen that when the arms 62–63 are swung inwardly and interleaved between the sheets of the newspaper "$N_{12}$" they engage the interior side of the half-fold and move the newspaper away from below the stack "N" until its leading fold enters the nip between the chain 23*a* and the belt 27*a* which then take over the movement of the newspaper so that the arms 62 and 63 can swing outwardly from between the sheets of the paper and around to position for engagement with a subsequent paper Having described our invention, we claim:

1. A method for folding a half-folded newspaper into compact configuration, said method consisting of the steps of (a) feeding the newspaper along a path normal to the half-fold at the mid-point thereof, (b) folding the newspaper back upon itself along a quarter-fold line that is coincident with the path while continuing to feed the newspaper along the path, (c) folding both of the lateral quarters of the newspaper forwardly upon themselves along eighth-fold lines that are parallel to the path and the quarter-fold line on opposite sides thereof and at the centers of the lateral quarters while continuing to feed the newspaper along the path, and (d) bringing the lateral edges of the newspaper into adjacency with and on opposite sides of the quarter-fold.

2. A method according to claim 1 and placing a retaining means around the exterior of the compacted eighth-folded newspaper.

3. A method according to claim 1 and the steps of folding a sheet of material around the exterior of each successive compacted newspaper, sealing the material to itself around the leading and trailing edges of the newspaper and cutting the folded and sealed sheet material between successive newspapers.

4. A method for folding a newspaper, or the like, into a compact, multi-folded shape that is adapted to be retained in such shape by subsequently applied physical restraining means, said method comprising the steps of (a) feeding a half-folded newspaper along a path line that is perpendicular to the half-fold and that is aligned with the center of the half-fold with the half-fold leading, (b) continuing to feed the newspaper along the path line while supporting only the portion thereof lying on the path line and folding the lateral quarters thereof backwardly upon itself on opposite sides of the path line, (c) continuing to feed the newspaper along the path line while folding the lateral quarters of the newspaper inwardly upon themselves toward the path line along two parallel, eighth-fold lines, one on each lateral side of the path line, which are parallel to and spaced equally from the path line and from the lateral edges of the newspaper and bringing the lateral edges thereof adjacent to the path line, (d) laterally compacting the folded newspaper, and (e) maintaining the newspaper in compacted, eighth-folded configuration while applying a physical restraining means to the folded newspaper.

5. A method according to claim 4 in which the step of applying a physical restraining means to the folded newspaper consists in over-wrapping sheet material around the folded newspaper and sealing the over-wrapped material to tightly enclose the newspaper.

6. A method according to claim 5 in which the step of over-wrapping consists of feeding a web of sheet material along with and at the eighth-folds of the newspaper, folding the sheet material around the newspaper with the outer margins of the sheet material extending beyond the newspaper, and sealing the sheet material to itself ahead of and behind the newspaper and at the margins.

7. A method according to claim 6 in which the sheet material is moisture proof and has a cohesive coating on the surface which is turned inwardly when the sheet material is formed around the newspaper.

8. A method according to claim 4 in which the step of applying a physical restraining means to the newspaper consists in making a tie around the compacted newspaper.

* * * * *